US011926948B2

(12) United States Patent
Kwon

(10) Patent No.: US 11,926,948 B2
(45) Date of Patent: Mar. 12, 2024

(54) CONTROL METHOD OF THE LAUNDRY APPARATUS

(71) Applicant: LG ELECTRONICS INC., Seoul (KR)

(72) Inventor: Baekeun Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 546 days.

(21) Appl. No.: 17/274,609

(22) PCT Filed: Sep. 20, 2019

(86) PCT No.: PCT/KR2019/012210
§ 371 (c)(1),
(2) Date: Mar. 9, 2021

(87) PCT Pub. No.: WO2020/060269
PCT Pub. Date: Mar. 26, 2020

(65) Prior Publication Data

US 2022/0049398 A1 Feb. 17, 2022

(30) Foreign Application Priority Data

Sep. 21, 2018 (KR) ..... 10-2018-0113990

(51) Int. Cl.

| | |
|---|---|
| ***D06F 33/48*** | (2020.01) |
| ***D06F 34/16*** | (2020.01) |
| ***D06F 34/18*** | (2020.01) |
| ***D06F 37/22*** | (2006.01) |
| ***D06F 37/30*** | (2020.01) |

(Continued)

(52) U.S. Cl.
CPC ..... *D06F 33/48* (2020.02); *D06F 34/16* (2020.02); *D06F 34/18* (2020.02); *D06F 37/22* (2013.01); *D06F 37/304* (2013.01); *D06F 2103/02* (2020.02); *D06F 2103/26* (2020.02); *D06F 2103/46* (2020.02); *D06F 2105/20* (2020.02); *D06F 2105/48* (2020.02); *D06F 2105/62* (2020.02)

(58) Field of Classification Search
CPC ..... D06F 33/48
See application file for complete search history.

(56) References Cited

U.S. PATENT DOCUMENTS

| | | | |
|---|---|---|---|
| 6,240,586 | B1 | 6/2001 | Joo |
| 2018/0148877 | A1 | 5/2018 | Chi et al. |

FOREIGN PATENT DOCUMENTS

| | | |
|---|---|---|
| EP | 3 252 201 A1 | 12/2017 |
| JP | 2010-017323 | 1/2010 |

(Continued)

OTHER PUBLICATIONS

International Search Report and Written Opinion dated Jan. 20, 2020 issued in Application PCT/KR2019/012210.

(Continued)

*Primary Examiner* — Jason Y Ko
(74) *Attorney, Agent, or Firm* — KED & Associates LLP

(57) ABSTRACT

A method for controlling a laundry treating apparatus is disclosed. In a washing step, the presence or absence of entangled laundry is detected using at least one of a vibration value of a drum, a current value applied to a drive unit, and an RPM value of the drum, and a step of untangling the entangled laundry is performed using at least one of a vibration value of a drum, a current value applied to a drive unit, and an RPM value of the drum.

20 Claims, 8 Drawing Sheets

(51) Int. Cl.

| | |
|---|---|
| *D06F 103/02* | (2020.01) |
| *D06F 103/26* | (2020.01) |
| *D06F 103/46* | (2020.01) |
| *D06F 105/20* | (2020.01) |
| *D06F 105/48* | (2020.01) |
| *D06F 105/62* | (2020.01) |

(56) References Cited

FOREIGN PATENT DOCUMENTS

| | | | |
|---|---|---|---|
| JP | 2010-069328 | | 4/2010 |
| KR | 10-2007-0073134 | | 7/2007 |
| KR | 10-2012-0109006 | A | 10/2012 |
| KR | 10-2014-0046522 | A | 4/2014 |
| KR | 10-2017-0135251 | A | 12/2017 |

OTHER PUBLICATIONS

Korean Office Action dated Oct. 28, 2022 issued in Kr Application No. 10-2018-0113990 (not attached).

(a)

(b)

CONTROL METHOD OF THE LAUNDRY APPARATUS

CROSS-REFERENCE TO RELATED PATENT APPLICATIONS

This application is a U.S. National Stage Application under 35 U.S.C. § 371 of PCT Application No. PCT/KR2019/012210, filed Sep. 20, 2019, which claims priority to Korean Patent Application No. 10-2018-0113990, filed Sep. 21, 2018, whose entire disclosures are hereby incorporated by reference.

TECHNICAL FIELD

The present disclosure relates to a method for controlling a laundry treating apparatus, and more particularly to a method for controlling a laundry treating apparatus to detect twisted or tangled laundry in a washing cycle as well as to untangle the twisted or tangled laundry.

BACKGROUND ART

Generally, a laundry treating apparatus may refer to an apparatus for washing laundry, an apparatus for drying laundry, and/or an apparatus for performing washing and drying of laundry. Here, the laundry treating apparatus may perform only a washing or drying function of laundry, or may perform both washing and drying functions of laundry.

In addition, a washing machine including a steam supply device to perform a refreshing function of removing wrinkles, odors, and static electricity has recently been developed and rapidly come into widespread use.

When the laundry treating apparatus is implemented as a washing machine, the laundry treating apparatus acting as the washing machine performs a washing cycle of removing foreign materials (or contaminants) from laundry, a rinsing cycle of separating the foreign materials (or contaminants) and a detergent from laundry, and a dehydration cycle of removing moisture from laundry.

A conventional laundry treating apparatus rotates by agitating a drum in a washing cycle or intermittently rotates the drum in one direction in a washing cycle, such that the conventional laundry treating apparatus can provide rolling force and frictional force to laundry in the drum so as to rub the laundry with detergent and water, resulting in washed laundry.

In the event that the conventional laundry treating apparatus is implemented as a front loading type washing machine provided with a door provided at a front part thereof, laundry is tumbled along an inner wall of a drum during rotation of the drum. Thus, during rotation of the drum, plural clothes in the drum may overlap each other and be in contact with each other, and may thus be twisted or entangled over time.

In addition, when the conventional laundry treating apparatus is implemented as a top loading type washing machine provided with a door provided at a top part thereof, laundry is tumbled in the drum during agitation of the drum, so that plural clothes in the drum may overlap each other and be in contact with each other. As a result, laundry in the drum may be twisted and entangled over time.

In this way, when laundry is twisted or entangled in the drum, water or detergent may not be suctioned or introduced into the tangled laundry, resulting in reduction in washing efficiency. In addition, twisted or tangled laundry may unavoidably rotate in the drum, resulting in damage to the laundry.

On the other hand, the conventional laundry treating apparatus may detect unbalance of the drum before entering the dehydration cycle, resulting in prevention of excessive eccentricity of laundry in the drum.

However, in the washing cycle, the drum rotates at a low speed, so that the drum may not excessively vibrate when rotating together with twisted or entangled laundry. Accordingly, twisted or entangled laundry may not cause the drum to enter an unbalance state during the washing cycle.

As a result, the conventional laundry treating apparatus has been designed not to include a means or method capable of detecting the presence or absence of twisted or entangled laundry during the washing cycle, so that it is impossible for the conventional laundry treating apparatus to detect twisted or entangled laundry in the washing cycle.

In addition, the conventional laundry treating apparatus has been designed not to include a means or method capable of untangling the twisted or entangled laundry during the washing cycle, so that it is impossible for the conventional laundry treating apparatus to untangle the twisted or entangled laundry in the washing cycle.

DISCLOSURE

Technical Problem

Accordingly, the present disclosure is directed to a method for controlling a laundry treating apparatus that substantially obviates one or more problems due to limitations and disadvantages of the related art.

An object of the present disclosure is to provide a method for controlling a laundry treating apparatus which detects twisted or entangled laundry during a washing cycle.

Another object of the present disclosure is to provide a method for controlling a laundry treating apparatus which detects twisted or entangled laundry even when an unbalance state of a drum is not detected.

Another object of the present disclosure is to provide a method for controlling a laundry treating apparatus which detects the presence or absence of twisted or entangled laundry in a washing cycle, and thus untangles the twisted or entangled laundry in the washing cycle.

Technical Solution

In accordance with one aspect of the present disclosure, a laundry treating apparatus may include a tub to store water, a drum provided in the tub to accommodate laundry, a drive unit coupled to the tub to rotate the drum, and a controller to detect vibration of the drum.

A method for controlling the laundry treating apparatus may include a tub to store water, a drum provided in the tub to accommodate laundry, a drive unit coupled to the tub to rotate the drum, and a controller to detect vibration of the drum may include a first rotation step in which the drum rotates at a first speed or less, a water supply step in which water is supplied to the tub, a second rotation step in which the drum rotates at a second speed higher than the first speed, a drain step in which water stored in the tub is discharged outside, and a step of detecting entangled laundry in a manner that, when a maximum vibration value of the drum is generated once or a minimum vibration value of the drum is generated once whenever the drum rotates once in the second rotation step, occurrence of entangled laundry is detected.

During the step of detecting entangled laundry, when a maximum vibration value of the drum is generated after detection of a maximum current value in the second rotation step, occurrence of entangled laundry may be detected.

The step of detecting the entangled laundry may include, if the maximum vibration value of the drum is generated at least two times after detection of the maximum current value, detecting occurrence of entangled laundry.

The step of detecting the entangled laundry may include detecting whether a waveform of the current value of the drum corresponds to a waveform of RPM value of the drum whenever the drum rotates, thereby detecting presence or absence of entangled clothes in the drum based on the detection result.

The step of detecting the entangled laundry may include, if a difference in a first time where the maximum current value occurs and a second time where the maximum vibration value of the drum occurs is equal to or shorter than a specific time in which the drum rotates only once, detecting occurrence of entangled laundry in the drum.

In the step of detecting entangled laundry, when a vibration value of the drum in the second rotation step is higher than a reference vibration value or greater during a predetermined time, occurrence of entangled laundry is detected. The predetermined time may be set to a time section in which the drum rotates at least two times.

The step of detecting the entangled laundry may be performed when the drum rotates in the same direction at a constant speed in the second rotation step.

The method may further include a step of untangling the entangled laundry in a manner that, when occurrence of entangled laundry is detected in the step of detecting the entangled laundry, a rotation speed of the drum is changed.

The step of untangling the entangled laundry may include stopping rotation of the drum.

The step of untangling the entangled laundry may include changing a rotation direction of the drum at least once.

The step of untangling the entangled laundry may include increasing the rotation speed of the drum such that the drum rotates at a second speed or greater, and stopping rotation of the drum.

The method may further include performing the step of untangling the entangled laundry at least two times.

The step of untangling the entangled laundry may include a water supply step in which water is supplied to the tub.

The step of untangling the entangled laundry may include rotating the drum in the water supply step or rotating the drum after completion of the water supply step.

It is to be understood that both the foregoing general description and the following detailed description of the present disclosure are exemplary and explanatory and are intended to provide further explanation of the invention as claimed.

Advantageous Effects

As is apparent from the above description, the method for controlling the laundry treating apparatus according to the embodiments of the present disclosure can detect the presence or absence of twisted or entangled laundry in the washing cycle.

Even when an unbalance state of a drum is not detected, the method for controlling the laundry treating apparatus according to the embodiments of the present disclosure can detect the presence or absence of twisted or entangled laundry in the drum.

When the presence of twisted or entangled laundry is detected in the washing cycle, the method for controlling the laundry treating apparatus according to the embodiments of the present disclosure can untangle the twisted or entangled laundry in the washing.

DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

MODE FOR INVENTION

Reference will now be made in detail to the embodiments of the present disclosure, examples of which are illustrated in the accompanying drawings. Wherever possible, the same reference numbers will be used throughout the drawings to refer to the same or similar parts. A singular expression may include a plural expression unless otherwise stated in the context. In the following description, a detailed description of related known configurations or functions incorporated herein will be omitted to avoid obscuring the subject matter. The accompanying drawings illustrate the exemplary embodiments of the present disclosure. The exemplary embodiments of the present disclosure are merely provided to describe the present disclosure in detail, and the technical range of the present disclosure is not limited by the exemplary embodiments.

Figure 1:
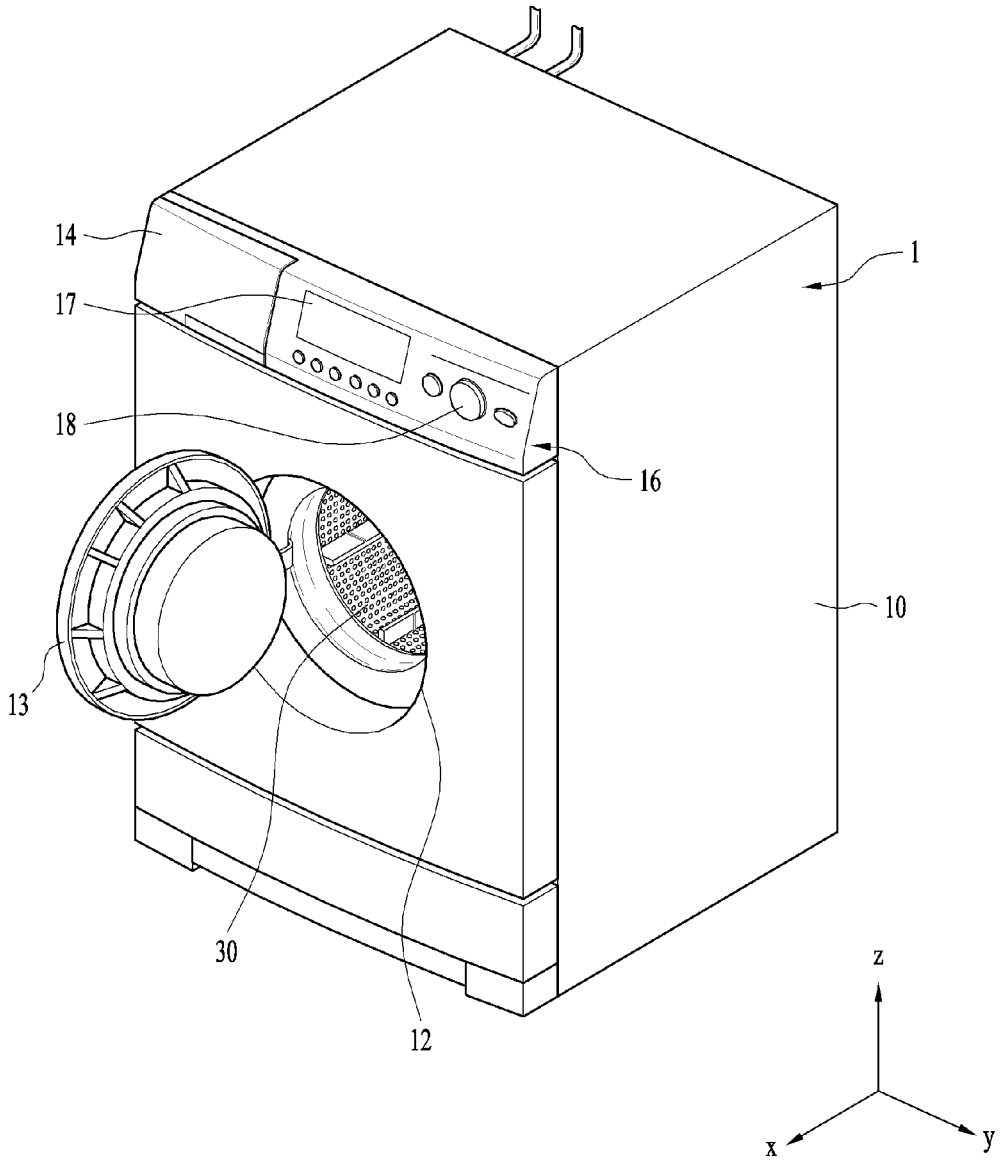
FIG. 1 is a perspective view illustrating a laundry treating apparatus according to the present disclosure.
Figure 2:
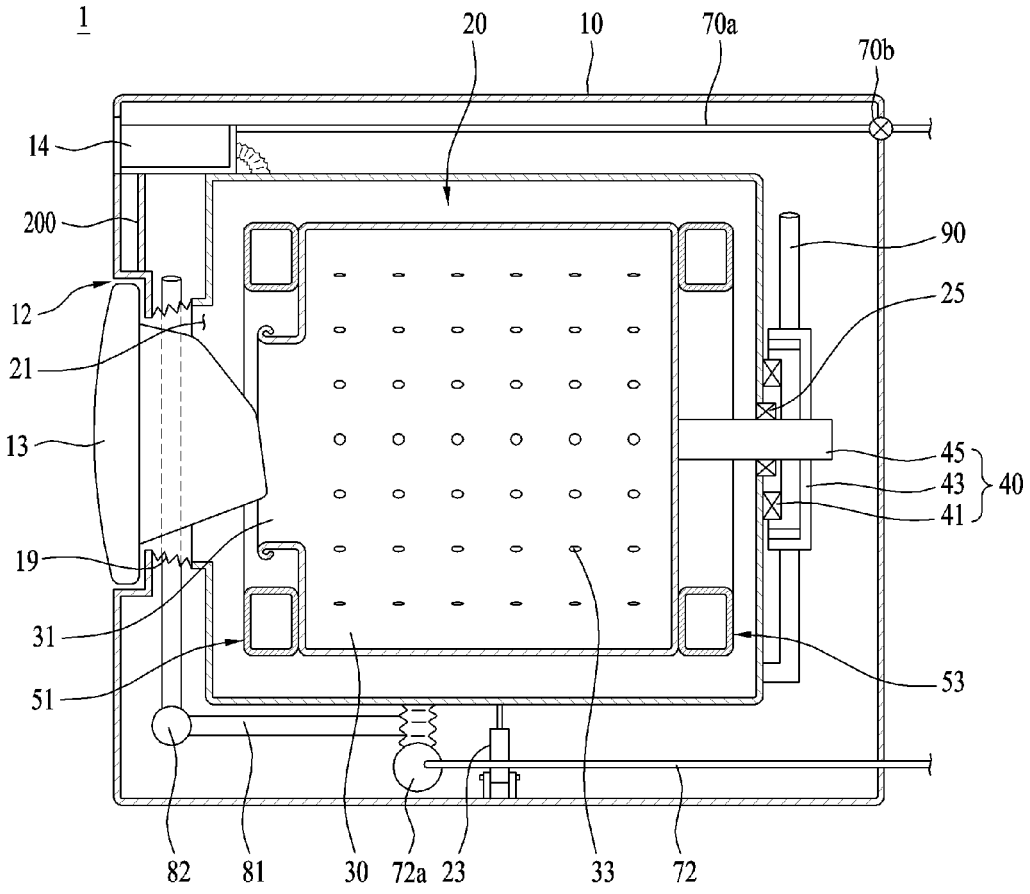
FIG. 2 is a cross-sectional view illustrating an internal structure of the laundry treating apparatus according to the present disclosure.

FIG. 1 is a perspective view illustrating a laundry treating apparatus according to the present disclosure. FIG. 2 is a cross-sectional view illustrating an internal structure of the laundry treating apparatus according to the present disclosure.

In an orthogonal coordinate system shown in the attached drawings, a positive (+) direction of an X-axis may be defined as a forward direction of the laundry treating apparatus, a negative (−) direction of the X-axis may be defined as a backward direction of the laundry treating apparatus, a positive (+) direction of a Z-axis may be defined as an upward direction of the laundry treating apparatus, and a negative (−) direction of the Z-axis may be defined as a downward direction of the laundry treating apparatus. In addition, a positive (+) direction of a Y-axis may be defined as a right direction of the laundry treating apparatus, and a negative (−) direction of the Y-axis may be defined as a left direction of the laundry treating apparatus.

Referring to FIG. 1, the laundry treating apparatus 1 may include a cabinet 10 forming an external appearance thereof, and a laundry accommodation unit 20' provided in the cabinet 10 to accommodate laundry therein.

The cabinet 10 may form an external appearance of the laundry treating apparatus 1, and may include an opening unit 12 through which laundry can be put into or taken out of a drum and a door 13 for opening or closing the opening unit 12. The door 13 may be rotatably connected to a front surface of the cabinet, and the opening unit 12 may be opened or closed according to rotation of the door 13.

On the other hand, although FIG. 1 illustrates a front loading type laundry treating apparatus in which the opening unit 12 and the door 13 are formed at the front surface of the cabinet 10, the scope or spirit of the present disclosure is not limited thereto, and a top loading type laundry treating apparatus in which the opening unit 12 and the door 13 are formed at a top surface of the cabinet 10 may also be used instead of the front loading type laundry treating apparatus as needed.

When the door 13 is coupled to the opening unit 12, the door 13 may be locked in a manner that the opening unit 12 is not opened. The door 13 may lock the opening unit 12 by a solenoid, a direct fastening means, etc.

A detergent box 14 and a control panel 16 may be provided at the front surface of the cabinet 10. The detergent box 14 may receive a detergent or softener, and may be detachably coupled to the cabinet. The control panel 16 may enable a user to input one or more operation commands, or may display state information of the laundry treating apparatus.

The detergent box 14 and the control panel 16 may be located above the opening unit 12 so that the user can easily grasp or contact the detergent box 14 and the control panel 16.

The detergent box 14 may be withdrawn forward and may store a powder detergent or a liquid detergent. For example, the detergent box 14 may be implemented as a drawer-type detergent box.

The control panel 16 may be provided at one side of the detergent box 14, and may include an input unit 18 and a display 17. The input unit 18 may receive at least one operation command including a washing cycle and option information related to the washing cycle from the user. The display 17 may display not only the command and information received from the user, but also a washing progress situation of laundry.

The input unit 18 may be implemented to include buttons, a rotary knob, or a touch panel. Although the display 17 includes a display unit provided with a liquid crystal display (LCD) and a speaker emitting sound, the display 17 may be provided in any shape capable of displaying a state of the laundry treating apparatus 1, and may be formed integrally with the input unit 18.

On the other hand, the control panel 16 may include a controller P configured to control the laundry treating apparatus 1.

The controller may receive power from an external power source, and may thus control electronic components of the laundry treating apparatus 1.

In this case, the electronic components (hereinafter referred to as load units) are connected in parallel to the controller, such that the respective load units (e.g., a driver, a water supply valve, a communication module, etc.) can operate independently from each other.

The laundry accommodation unit 20' provided in the cabinet 10 may include a tub 20 to store water, and a drum 30 rotatably provided in the tub 20 to receive laundry.

Referring to FIG. 2, the tub 20 may be provided in the cabinet 10, and may form a space to store wash water therein. For example, the tub may be formed in a cylindrical shape.

The tub 20 may include a tub inlet 21 through which laundry is put into or withdrawn, and a tub support unit 23 to fix the tub 20 into the cabinet 10. The tub inlet 21 may be formed to communicate with the inlet 12. The tub support unit 23 may be provided below the tub 20, and may attenuate (or reduce) vibration generated by the tub 20. For example, the tub support unit may include a damper, a spring, etc.

The tub 20 may further include a water level sensor 90. The water level sensor 90 may be provided at one side of the tub 20, and may thus measure a water level of water stored in the tub 20. The water level sensor 90 may include an extension pipe to extend from a lower end of the tub 20 to an upper part of the tub 20, a diaphragm provided by sealing the upper end of the extension pipe, and a sensor to detect the number of vibrations of the diaphragm.

In addition, the laundry treating apparatus 1 may further include a vibration sensor 92 to detect the presence or absence of vibration in the tub 20. The vibration sensor 92 may detect at least one of vibration in an X-axis, vibration in a Y-axis, and vibration in a Z-axis, and may transmit state information of the tub 20 to the controller.

The drum 30 may be rotatably provided in the tub 20, and may include a drum inlet 31 through which laundry can be put into or withdrawn. For example, the drum may be formed in a cylindrical shape. The drum inlet 31 may be formed to communicate the inlet 12 and the tub inlet 21. Therefore, laundry can be introduced into the drum 30 after sequentially passing through the inlet 12, the tub inlet 21, and the drum inlet 31.

On the other hand, a gasket 19 may be further provided between the inlet 12 of the cabinet 10 and the tub inlet 21 of the tub 20. The gasket 19 may prevent wash water stored in the tub 20 from leaking to the cabinet 10, and may also prevent vibration generated by the tub 20 from being transferred to the cabinet 10. For example, the gasket may be formed of an elastic member.

A plurality of through-holes 33 communicating with the tub 20 may be formed at the inner circumferential surface of the drum 30. Wash water stored in the tub 20 may flow into the drum 30 via the through-holes 33, and wash water stored in the drum 30 may be discharged to the tub 20 via the through-holes 33.

The laundry treating apparatus 1 may include a drive unit 40, a water-supply unit 70, and a drain unit 72. The drive unit 40 may be coupled to the tub 20 so as to rotate the drum 30.

The water-supply unit 70 may supply wash water to the tub 20. The drain unit 72 may discharge wash water from the tub 20 to the outside.

The drain unit 72 may be implemented as a drain pipe communicating with the tub 20, and may include a drain pump 72*a* connected to the drain pipe so as to drain water from the tub 20.

The water-supply unit 70 may include a water-supply pipe 701 to supply the tub 20 with water, and a water-supply valve 70*b* to open or close the water-supply pipe 70*a*. The water-supply pipe 70*a* may communicate with the detergent box 14.

Accordingly, the detergent box 14 may also communicate with the tub 20 so that the detergent box may automatically supply the tub 20 with a detergent when water is supplied to the tub 20.

Meanwhile, the laundry treating apparatus 1 may further include a circulation unit 80 to re-circulate water drained from the tub 20. The circulation unit 80 may include a circulation passage 81 connected to both ends of the tub 20, and a circulation pump 82 to provide the circulation passage 81 with drive power.

The circulation pump 82 may pressurize wash water by communicating with the bottom surface of the tub 20. One end of the circulation passage 81 may be connected to the circulation pump, and the other end of the circulation passage 81 may be connected to the gasket 19, such that wash water can be sprayed into the drum.

However, there is a need for the circulation passage and the circulation pump to spray wash water stored in the tub, and there is no need to exclude the exemplary case in which wash water is sprayed into the drum through a spray water-supply passage connected to a water-supply source located outside the cabinet.

That is, one side of the spray water-supply passage may be connected to the water-supply source, and the other side of the spray water-supply passage may be connected to the tub. If the laundry treating apparatus 1 includes a nozzle through which wash water can be sprayed into the drum, wash water can be sprayed into the drum through a filtration motion or a squeeze motion using the nozzle.

In addition, the laundry treating apparatus 1 may further include balancers 51 and 53 to attenuate (or reduce) vibrations generated in the drum 30. The balancers 51 and 53 may remove eccentricity of the drum 30 affected by laundry biased to one side in the drum 30. That is, the balancers 51 and 53 may move to a specific position under control of a microprocessor, such that unbalance of the drum 30 can be attenuated or reduced.

In this case, the balancer may be provided at each of the front side and the rear side of the drum 30, or may be provided only at either the front side or the rear side of the drum 30. For example, the balancer may include the front balancer 51 provided at the front side of the drum 30 and the rear balancer 53 provided at the rear side of the drum 30. The balancers 51 and 53 may be implemented as a ball balancer, a liquid balancer, etc.

The drive unit 40 may be located outside the tub 20, and may be coupled to or may pass through a rear surface of the tub 20, such that the drive unit 40 may be connected to the drum 30. The drive unit 40 may be fixed to the rear surface of the tub 20, and may thus convert electrical energy into mechanical energy. That is, the drive unit 40 may rotate the drum 30 by receiving a current from the outside.

The drive unit 40 may include a stator 41 to generate a magnetic field, a rotor 43 to rotate in the stator 41 by a magnetic field, and a rotary shaft 45 configured to pass through the rear surface of the tub 20 so that the drum 30 is connected to the rotor 43 through the rotary shaft 45.

The drive unit may be a brushless direct current (BLDC) motor. In this case, the stator 41 may be implemented as a coil, and the rotor 43 may be a permanent magnet. Meanwhile, the bottom surface of the tub 20 may be provided with a rotary shaft bearing 25 configured to rotatably support the rotary shaft 45.

Figure 3:
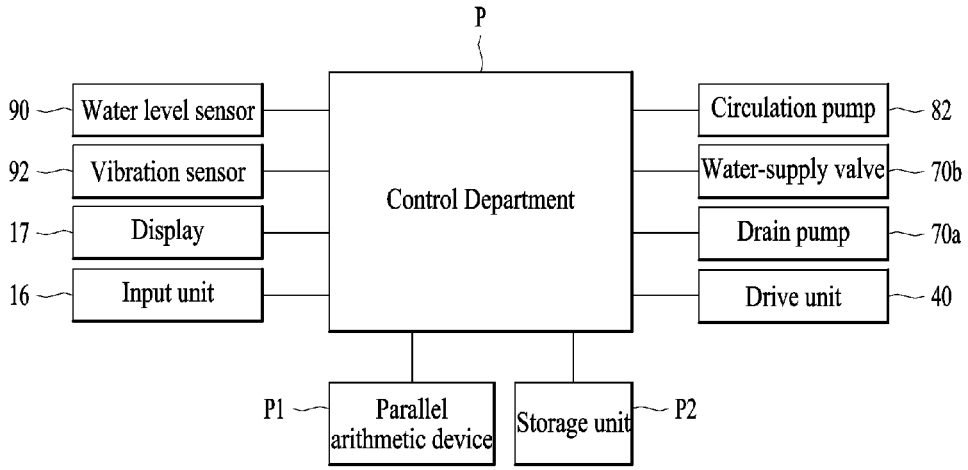
FIG. 3 is a block diagram illustrating a controller contained in the laundry treating apparatus according to the present disclosure.
Figure 3:
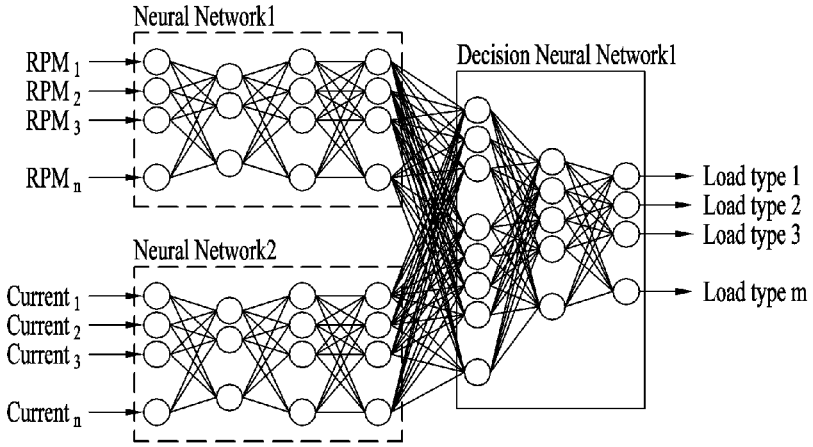

FIG. 3 is a block diagram illustrating the controller P for controlling load according to the present disclosure.

Referring to FIG. 3(*a*), the controller P may be provided to the control panel or the like, may receive a command for operating the laundry treating apparatus through the input unit 16, and may thus perform a washing course and an optional menu. That is, while the controller P performs the decided washing course and optional menu, the controller P may control the water-supply valve 70*b*, the drain pump 70*a*, and the drive unit 40 using water level information detected by the water-level sensor 90.

In addition, the controller P may provide a current state of the laundry treating apparatus through the display 17, and may be configured to detect vibration of the drum through a current value applied to either the vibration sensor 92 or the drive unit 40.

On the other hand, the controller P may further include a parallel arithmetic device P1 which receives various signals, for example, a signal value of the vibration sensor 92, a current value applied to the drive unit 40, an RPM value of the drum 30, etc. and processes the received signals. In addition, the controller P may further include a storage unit P2 which stores data processed by the parallel arithmetic device P1, stores an algorithm capable of operating the parallel arithmetic device P1, and stores various electrical signals applied to the parallel arithmetic device P1.

The controller P according to the present disclosure may include the parallel arithmetic device P1 and the storage unit P2, such that an artificial neural network learning logic for creating a neural network can be implemented. The artificial neural network may combine and analyze a plurality of factors to derive a single consistent resultant value.

A conventional controller for use in the conventional laundry treating apparatus has disadvantages in that only one output value can be acquired using only one input value. However, the laundry treating apparatus according to the present disclosure can utilize two or more signals through the parallel arithmetic device P1, such that the laundry treating apparatus can more accurately acquire much more necessary information as compared to another case in which the conventional laundry treating apparatus can use only one signal.

Referring to FIG. 3(*b*), the controller P according to the present disclosure may receive at least two data selected from among an RPM waveform, a current value, a current waveform, the amount of vibration, etc., and may recognize the weight of laundry, the state of laundry, and the type of laundry by synthetically analyzing the received data. As a result, the controller P can precisely control the RPM of the drum.

For example, the controller P may control the parallel arithmetic device P1 to process RPM waveforms using the artificial neural network, may process an input current value using the artificial neural network, and may recognize the weight, state, and type of laundry corresponding to new factors through a decision neural network capable of combining and processing the processed resultant values.

Specifically, the RPM waveforms, current waveforms, and vibration waveforms applied to the controller P may be dependent upon the type, weight, and control RPM of load contained in the washing machine. Therefore, in the event that information about a representative value pre-tested according to the weight and control RPM of load is contained in the decision neural network acquired by the storage unit P2 or by the parallel arithmetic device P1, if measurement data generated in the washing machine is reversely calculated through the artificial neural network, more correct information about the type and weight of load can be inversely calculated.

Figure 4:
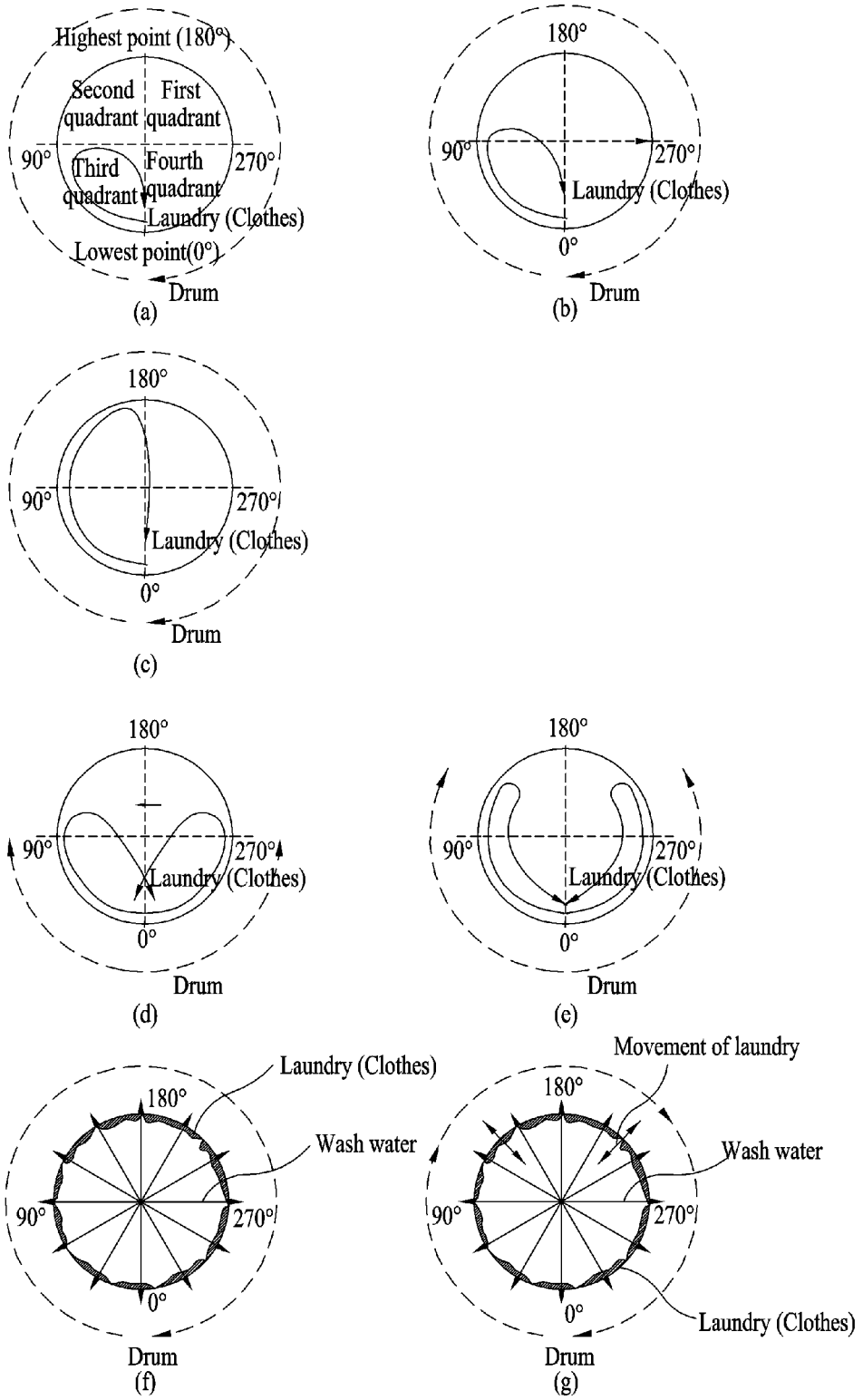
FIG. 4 is a conceptual diagram illustrating a rotational motion of the drum according to the present disclosure.

FIG. 4 is a conceptual diagram illustrating various drum drive motions for use in various methods (e.g., a washing cycle, a rinsing cycle, etc.) of controlling the washing machine according to the present disclosure.

Referring to FIG. 4, the drum drive motion may refer to a combination of the rotation direction of the drum and the rotation speed of the drum. By the drum drive motion, the falling direction and the falling time of laundry contained in the drum may be changed, such that movement of such laundry in the drum may be changed. The drum drive motion may be implemented by controlling the drive unit.

Laundry may be lifted by a lift provided at the inner circumferential surface of the drum during rotation of the drum in a manner that the rotation speed and the rotation direction of the drum may be controlled, such that impact applied to laundry may be changed. In other words, frictional force between clothes, frictional force between the laundry and wash water, and mechanical force such as drop impact of such laundry can be changed according to the rotation speed and the rotation direction of the drum. In order to wash clothes, the amount of impact to be applied to the clothes may be changed or information about how many times the clothes in the drum are rubbed against each other may be changed, such that distribution of clothes in the drum or rolling force of clothes in the drum may be changed.

Accordingly, the laundry treating apparatus according to the present disclosure may change the drum drive motion in different ways according to types of laundry, pollution levels of laundry, individual cycles, and detailed steps of each cycle, such that laundry can be processed at optimum mechanical force, resulting in increased washing efficiency of laundry.

In order to implement various drum drive motions, the drive unit 40 may be a direct-coupled motor. That is, the stator of the motor may be fixed to the rear side of the tub 20, and the rotor of the motor may rotate so that the drum 30 can be directly driven. As a result, the rotation direction, torque, etc. of the motor can be controlled, a time delay or backlash can be maximally prevented and the drum drive motion can be immediately controlled.

FIG. 4(*a*) is a conceptual diagram illustrating a rolling motion. The rolling motion may refer to a motion in which the drive unit 40 rotates the drum 30 in one direction such that it may be possible for laundry rolling along the inner circumferential surface of the drum to drop from a specific position corresponding to about 90° or less of the rotation direction of the drum to the lowest position of the drum.

That is, when the drive unit 40 rotates the drum at a rotation speed of about 40 RPM, laundry located at the lowest position of the drum 30 may be lifted to a predetermined height in the rotation direction of the drum 30, such that the laundry may start rolling at a specific position corresponding to about 90° or less of the rotation direction of the drum on the basis of the lowest position of the drum, and may drop from the specific position to the lowest position of the drum. When the drum rotates clockwise, clothes may be continuously tumbled or rolled at the third quadrant of the drum.

Laundry may be washed by frictional force between laundry and water, frictional force between clothes, and frictional force between the inner circumferential surface of the drum and the laundry through the rolling motion. In addition, through the above-mentioned motion, laundry can be turned over a sufficient number of times, such that laundry to be washed can be smoothly rubbed.

Here, the drum RPM may be determined dependent upon the relationship between the drum RPM and the radius of the drum. That is, as the drum RPM increases, greater centrifugal force may occur in laundry contained in the drum. Due to a difference between centrifugal force and gravitational force, movement of laundry placed in the drum may be changed. Of course, there is a need for rotational force of the drum and frictional force between the drum and laundry to be considered.

Therefore, the drum RPM of the rolling motion may be decided in a manner that each of centrifugal force and frictional force is less than gravitational force (1G).

FIG. 4(*b*) is a conceptual diagram illustrating the tumbling motion.

The tumbling motion may refer to a motion in which the drive unit 40 rotates the drum 30 in one direction such that it may be possible for laundry rolling along the inner circumferential surface of the drum to drop from a specific position corresponding to about 90°~110° of the rotation direction of the drum to the lowest position of the drum. When the drum rotates at a proper RPM in one direction during the tumbling motion, mechanical force may occur, such that the tumbling motion may act as a drum drive motion generally used in the washing and rinsing cycles.

That is, laundry put into the drum 30 may be located at the lowest position of the drum 30 before the drive unit 40 is driven. When the drive unit 40 provides the drum 30 with torque, the drum 30 may rotate, and the lift located at the inner circumferential surface of the drum may move laundry in an upward direction from the lowest position of the drum to a predetermined height. If the driver 40 rotates the drum 30 at a rotation speed of about 46 RPM, laundry may start rolling at a specific position corresponding to about 90°~110° of the rotation direction of the drum on the basis of the lowest position of the drum, and may drop from the specific position to the lowest position of the drum.

The drum RPM of the tumbling motion may be decided in a manner that centrifugal force of the tumbling motion is greater than centrifugal force of the rolling motion whereas the centrifugal force of the tumbling motion is less than gravitational force.

When the drum rotates clockwise in the tumbling motion, laundry may move from the third quadrant to some parts of the second quadrant on the basis of the lowest position of the drum, and may drop from the inner circumferential surface of the drum to the lowest position of the drum.

Therefore, the tumbling motion may allow laundry to be washed not only by frictional force between laundry and water, but also by impact force caused by fallen laundry, such that the tumbling motion can provide the laundry with greater mechanical force than the rolling motion. The tumbling motion may refer to a motion in which clothes can be lifted upward and fallen to the bottom of the drum in a repeated manner, such that the entangled clothes can be untangled and distributed in the drum.

FIG. 4(*c*) is a conceptual diagram illustrating the step motion. The step motion may refer to a motion in which the drive unit 40 rotates the drum 30 in one direction such that it may be possible for laundry rolling along the inner circumferential surface of the drum 30 to drop from the highest position (corresponding to about 180°) of the rotation direction of the drum 30 to the lowest position of the drum 30.

If the drive unit 40 rotates the drum 30 at a rotation speed of about 60 RPM, laundry can rotate in the drum by centrifugal force without dropping to the bottom of the drum. The step motion may refer to a motion in which the drum 30 rotates at a rotation speed where laundry does not drop from the inner circumferential surface of the drum by centrifugal force, and the drum 30 is then suddenly braked, such that impact force to be applied to the laundry can be maximized.

In the step motion, after the drive unit 40 rotates the drum 30 at a rotation speed (about 60 RPM or higher) where laundry does not drop from the outer circumferential surface of the drum by centrifugal force, when the laundry is located in the vicinity of the highest position (corresponding to about 180° of the rotation direction) of the drum 30, the drive unit 40 may supply reverse torque to the drum 30.

Accordingly, as soon as the drum 30 is stopped by reverse torque of the drive unit 40 after laundry is lifted in the rotation direction of the drum 30 from the lowest position of the drum 30, the laundry drops from the highest position of the drum 30 to the lowest position of the drum 30, such that the step motion may refer to a motion in which laundry contained in the drum 30 is washed by impact force generated in the process of dropping the laundry to a maximum fall. Mechanical force generated by the step motion may be greater than the rolling motion or the tumbling motion.

The step motion may refer to a motion in which, during clockwise rotation of the drum, laundry may move from the lowest position of the drum to the highest position of the drum after passing through the third quadrant and the second quadrant, may suddenly escape from the inner circumferential surface of the drum, and may drop to the lowest position of the drum. Therefore, laundry drops from a maximum height within the drum during the step motion, such that mechanical force can be more effectively applied to a small amount of laundry.

Meanwhile, the drive unit 40 may be reverse-phase braked to perform braking of the drum. The reverse-phase braking may refer to a scheme for braking the motor by generating rotational force in a direction opposite to the rotation direction of the motor. In order to generate the rotational force in the direction opposite to the rotation direction of the motor, the phase of a current supplied to the motor may be reversed. The reverse-phase braking may enable sudden braking of the motor. Therefore, the reverse-phase braking scheme may be considered most suitable for the step motion of supplying strong impact to laundry.

Thereafter, the drive unit 40 may again supply torque to the drum 30, such that laundry located at the lowest position of the drum may be lifted to the highest position of the drum. That is, after torque is supplied to the drum 30 in a manner that the drum 30 rotates clockwise, such torque is re-supplied to the drum 30 in a manner that the drum 30 is suddenly stopped by rotating counterclockwise. Thereafter, torque is also re-supplied to the drum 30 in a manner that the drum 30 re-rotates clockwise, resulting in implementation of the step motion.

Consequently, the step motion may refer to a motion in which, during rotation of the drum, frictional force occurs between wash water introduced via through-holes formed at the inner wall of the drum and the laundry, and the laundry is washed by impact force generated when the laundry drops from the highest position of the drum to the bottom of the drum.

FIG. 4(*d*) is a conceptual diagram illustrating the swing motion. The swing motion may refer to a motion in which the drive unit 40 rotates the drum 30 in both directions such that it may be possible for laundry to drop from a specific position (corresponding to about 90° of the rotation direction of the drum 30 to the lowest position of the drum 30.

In other words, when the drive unit 40 rotates the drum 30 in a counterclockwise direction at a rotation speed of about 40 RPM, laundry located at the lowest position of the drum 30 may be lifted counterclockwise to a predetermined height. In this case, the drive unit 40 may allow laundry to pass through a specific position corresponding to 90° of the counterclockwise direction of the drum 30, and may stop rotation of the drum 30, such that laundry may drop from the specific position corresponding to 90° of the counterclockwise direction of the drum 30 to the lowest position of the drum 30.

Thereafter, the drive unit 40 may rotate the drum 30 in a clockwise direction at a rotation speed of about 40 RPM such that laundry can be lifted clockwise to a predetermined height in the rotation direction of the drum 30. Meanwhile, the drive unit 40 may enable laundry to pass through the position corresponding to 90° of the clockwise direction of the drum 30 and to stop rotation of the drum 30, such that the laundry can drop from the position corresponding to 90° of the clockwise direction of the drum 30 to the lowest position of the drum 30.

That is, the swing motion may refer to a motion in which the drum 30 rotates in one direction, stops rotation, rotates in a direction opposite to the one direction, and then stops rotation in the opposite direction in a repeated manner. In more detail, during the swing motion, laundry is lifted from the third quadrant of the drum 30 to some parts of the second quadrant of the drum 30, smoothly drops to the lowest position of the drum 30, is lifted from the fourth quadrant of the drum 30 to some parts of the first quadrant of the drum 30, and then smoothly drops to the lowest position of the drum 30, such that the above-mentioned lifting and dropping of laundry may be repeatedly performed in the switching motion.

In this case, braking of the drive unit 40 may minimize load encountered in the drive unit 40 using dynamic braking, such that mechanical abrasion of the drive unit 40 can be minimized and impact to be applied to laundry can be adjusted.

The above dynamic braking may refer to a braking method for enabling the motor to serve as a generator by rotational inertia when a current to be applied to the drive unit is turned off. When the current to be applied to the motor is turned off, the direction of the current flowing into the coil of the motor is opposite to the direction of the current flowing into the motor before the motor is powered off, force (Fleming's Right-Hand Rule) may occur in the direction in which rotation of the motor is disturbed, resulting in braking of the motor. Although the dynamic braking mode does not suddenly brake the motor in a different way from the reverse-phase braking mode, the dynamic braking mode can smoothly switch the rotation direction of the drum.

Therefore, during the swing motion, clothes are laterally placed and moved in a figure-eight shape across the third and fourth quadrants of the drum 30.

FIG. 4(*e*) is a conceptual diagram illustrating the scrub motion. The scrub motion may refer to a motion in which the drive unit 40 rotates the drum 30 in both directions such that it may be possible for laundry to drop from a specific position (corresponding to about 90° or greater) of the rotation direction of the drum 30 to the lowest position of the drum 30 through reverse-phase braking.

That is, when the drive unit 40 rotates the drum 30 counterclockwise at a rotation speed of about 60 RPM, laundry located at the lowest position of the drum 30 may be lifted counterclockwise to a predetermined height. In this case, after laundry passes through the position corresponding to about 90° of the counterclockwise direction of the drum 30, the drive unit 40 provides reverse torque to the drum, rotation of the drum 30 may be temporarily stopped. As a result, laundry rolling at the inner circumferential surface of the drum 30 may abruptly drop to the bottom of the drum 30.

Thereafter, the drive unit 40 rotates the drum 30 in the clockwise direction at a rotation speed of about 60 RPM, so that laundry may be lifted to a predetermined height from the bottom of the drum 30. After laundry passes through the position corresponding to 90° of the clockwise direction of the drum 30, the drive unit 40 provides reverse torque to the drum 30, and the drive unit 40 may temporarily stop rotation of the drum 30. As a result, laundry rolling at the inner circumferential surface of the drum 30 may drop from the position corresponding to 90° of the clockwise direction of the drum 30 to the lowest position of the drum 30.

Therefore, during the scrub motion, laundry may abruptly drop from the predetermined height of the drum 30 to the bottom of the drum 30, such that the laundry can be washed. Meanwhile, the drive unit 40 may be reverse-phase braked for braking of the drum 30.

Since the rotation direction of the drum 30 is rapidly switched, clothes may not greatly escape from the inner circumferential surface of the drum 30, so that the clothes can be strongly rubbed against each other. The scrub motion may refer to a motion in which laundry having moved from the third quadrant to the second quadrant of the drum 30 rapidly drops to the bottom of the drum 30, then moves from the fourth quadrant to some parts of the first quadrant of the drum 30, and finally drops to the bottom of the drum 30, such that the above-mentioned lifting and dropping of laundry rolling at the inner circumferential surface of the drum 30 may be repeatedly performed in the scrub motion.

FIG. 4(*f*) is a conceptual diagram illustrating the filtration motion. The filtration motion may refer to a motion in which the drive unit 40 rotates the drum 30 in a manner that laundry does not drop from the inner circumferential surface of the drum 30 by centrifugal force and wash water can be sprayed into the drum 30.

That is, during the filtration motion, clothes distributed on the drum 30 are rotated while closely contacting the inner circumferential surface of the drum 30, and at the same time water is sprayed into the drum 30, such that water can be discharged to the tub 20 after passing through the clothes and through-holes of the drum 30 by centrifugal force. Accordingly, the filtration motion may increase a surface area where laundry is in contact with wash water, and may allow wash water to pass through the clothes, such that the wash water can be evenly distributed to the clothes in the drum 30.

The method for spraying wash water into the drum during the filtration motion may be implemented using the circulation passage and the circulation pump which are configured to circulate the wash water to be sprayed into the drum 30.

On the other hand, the filtration motion may enable clothes only to rotate in the drum 30 while closely contacting the inner circumferential surface of the drum 30 without spraying water into the drum 30.

In addition, the filtration motion may be implemented by spraying clean water received from the external water supply source into the drum 30 without circulating wash water stored in the tub. In order to identify the filtration motion from the other case in which wash water stored in the tub is circulated in the drum 30, the above-mentioned motion may be defined as a spray rinse motion. Clean water is used in the spray rinse motion, such that the spray rinse motion may be suitable for the rinsing cycle.

FIG. 4(*g*) is a conceptual diagram illustrating the squeeze motion. The squeeze motion may refer to a motion in which the drive unit 40 rotates the drum 30 in a manner that laundry does not drop from the inner circumferential surface of the drum by centrifugal force, the rotation speed of the drum 30 is reduced to separate laundry from the inner circumferential surface of the drum 30, and wash water can be sprayed into the drum 30 during rotation of the drum 30, such that the above-mentioned operations are repeatedly performed in the squeeze motion.

That is, whereas the filtration motion may enable laundry to continuously rotate at a rotation speed where laundry does not drop from the inner circumferential surface of the drum, the squeeze motion may change the rotation speed of the drum so that laundry closely contacts the inner circumferential surface of the drum 30 and is then separated from the inner circumferential surface of the drum 30 in a manner that the above contact and separation operations of such laundry can be repeatedly performed.

The process of spraying water into the drum 30 from among the filtration motion and the squeeze motion may be implemented through the circulation passage and the circulation pump.

The rolling motion, the tumbling motion, the step motion, the swing motion, the scrub motion, and the squeeze motion may be mainly applied to the washing cycle or the rinsing cycle, and the filtration motion may be mainly applied to the dehydration cycle.

Figure 5:
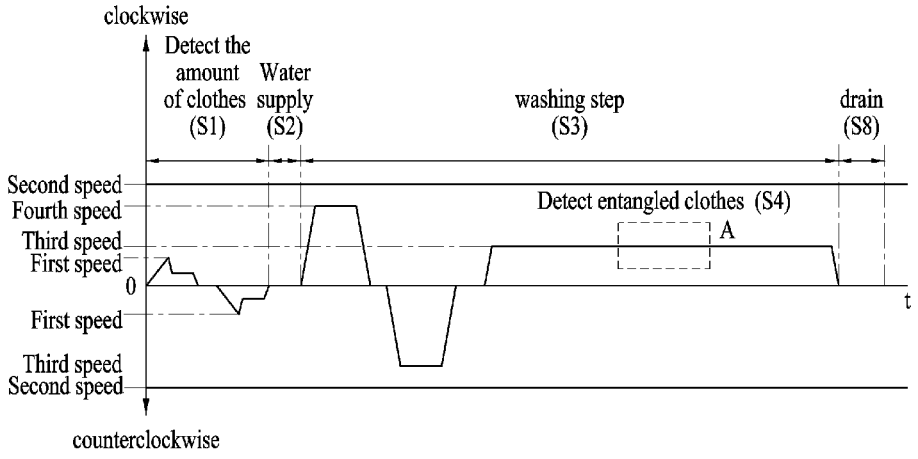
FIG. 5 is a conceptual diagram illustrating a washing cycle of the laundry treating apparatus according to the present disclosure.

FIG. 5 is a conceptual diagram illustrating the washing process of the laundry treating apparatus according to the present disclosure.

Referring to FIG. 5, the washing cycle may include a first rotation step, a water supply step, a washing step or a second rotation step, and a drain step. In the first rotation step, the drum may rotate at a first speed. In the water supply step, water may be supplied to the tub. In the washing step or the second rotation step, the drum may rotate at a second speed lower than the first speed. In the drain step, water can be drained from the tub.

The first rotation step may be considered as a laundry-amount sensing step S1 in which the drum is preliminarily rotated to sense the amount of laundry contained in the drum. In the laundry-amount sensing step S1, the drum may horizontally agitate at a low speed, and the controller P may detect the amount of laundry based on a current value applied to the drive unit. Therefore, the first speed may be lower than a speed of performing the drum drive motion.

In the water supply step S2, water suitable for the amount of laundry detected by the laundry-amount sensing step S1 can be supplied to the tub.

The second rotation step S3 may be performed after execution of the water supply step S2, such that laundry is mainly washed and the drum drive motion is also performed in the second rotation step S3. In the second rotation step S3, the rolling motion, the tumbling motion, the step motion, the swing motion, and the scrub motion may be carried out. In more detail, the drum may rotate in one direction in each of the rolling motion, the tumbling motion, and the step motion, and the drum may rotate in both directions in each of the swing motion and the scrub motion. In the second rotation step S3, the drum may rotate at a higher speed than the first speed. In the second rotation step S3, the drum may rotate at a speed less than the second speed corresponding to a minimum speed where laundry can rotate at the inner circumferential surface of the drum while closely contacting the inner circumferential surface of the drum. This is because moisture contained in the laundry escapes from the drum when the drum rotates at a speed higher than the second speed. As a result, the second speed may be defined as a dehydration speed.

Referring to FIG. 5, the laundry treating apparatus according to the present disclosure may mainly perform the tumbling or rolling motion selected from among the drum drive motions.

The reason why the tumbling or rolling motion is performed is as follows. During the rolling or tumbling motion selected from among the drum drive motions, the drum may rotate at a constant speed in one direction, a small amount of energy is consumed, and mechanical force is continuously applied to laundry, resulting in superior washing performance.

In addition, the laundry treating apparatus according to the present disclosure may perform the swing motion or the scrub motion prior to execution of the rolling motion or the tumbling motion. The swing motion or the scrub motion may be performed in a manner that clothes can be evenly distributed in the drum, such that eccentricity of the clothes can be removed from the drum.

Thereafter, the laundry treating apparatus according to the present disclosure may perform the drain step S8 after completion of the second rotation step S3, such that water, foreign material, and detergent contained in the tub can be discharged outside.

As described above, during the second rotation step S3, when the drum rotates at a constant speed less than the second speed in the same manner as in the rolling motion or the tumbling motion, washing performance may be improved but clothes may roll in one direction so that there is a high possibility that twisted or entangled clothes occur in the drum.

When twisted or entangled clothes occur in the drum, it is impossible for water or detergent to penetrate the clothes, resulting in reduction in washing performance. In addition, when clothes are twisted or entangled, the twisted or entangled clothes may unavoidably roll in the drum so that there is a high possibility that clothes may be unexpectedly deformed or damaged.

However, during the second rotation step S3, the drum may rotate at a speed less than the second speed in a manner that the drum may not excessively vibrate. As a result, during the second rotation step S3, when detecting the presence or absence of eccentricity or unbalance of clothes contained in the drum, the controller P may have difficulty in recognizing presence of such twisted or entangled clothes in the drum.

Therefore, the laundry treating apparatus according to the present disclosure may further perform a control method for sensing the twisted or entangled clothes in the drum without directly sensing the eccentricity or unbalance of clothes in the drum.

Figure 6:
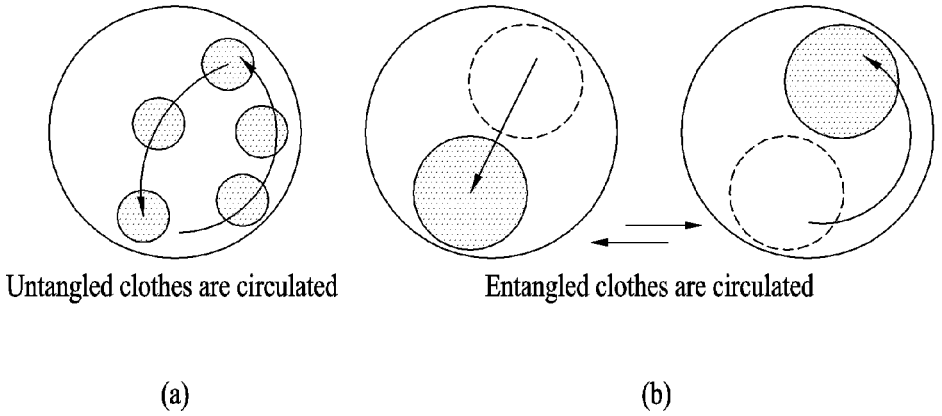
FIG. 6 is a conceptual diagram illustrating normal laundry and entangled laundry in the washing cycle according to the present disclosure.

FIG. 6 is a conceptual diagram illustrating various states of laundry placed in the drum.

Referring to FIG. 6(*a*), during rotation of the drum, laundry may be lifted upward along the inner circumferential surface of the drum, and may then drop to the bottom of the drum in the rotation direction of the drum by weight and inertial force of the laundry. In this case, when twisted or entangled clothes are not generated in the drum, the respective clothes may be independently lifted upward and then drop to the bottom of the drum. In other words, untangled clothes may be evenly distributed and circulated in the drum. As a result, although the untangled clothes drop to the bottom of the drum, large impact is not applied to the untangled clothes in the drum, normal impact can be applied to the untangled clothes at intervals of a short period of time, and RPM values may be relatively and evenly changed.

Referring to FIG. 6(*b*), when the entangled clothes occur in the drum, a large amount of clothes may be simultaneously lifted upward and then simultaneously drop to the bottom of the drum. In more detail, although some entangled clothes occur, a smaller number of entangled clothes may occur and circulate in the drum. When the entangled clothes drop from the highest position to the lowest position of the drum, large impact may be applied to the entangled clothes, and such impact may also be applied to the entangled clothes at intervals of a short period of time. As a result, variable RPM and uneven force may be applied to the clothes during rotation of the drum.

As a result, clothes may be located at various positions in the drum, such that it is substantially difficult to distinguish the entanglement levels of entangled clothes from each other according to arrangements of such clothes in the drum. However, it may be possible to distinguish the entangled states of clothes from each other based on the lifting or dropping actions of such entangled clothes. In addition, a voltage, a current, an RPM value, and a vibration sensor pattern, which are to be applied to the motor, may be changed according to the entanglement levels of such clothes in the drum.

According to the above-mentioned principles, the laundry treating apparatus according to the present disclosure may synthetically analyze the RPM, the current, waveforms of the current, a vibration value, and waveforms of the vibration value, such that the laundry can correctly recognize the presence or absence of entangled clothes in the drum.

In addition, the laundry treating apparatus according to the present disclosure may also estimate the entanglement level of entangled clothes by combination of physical movement of such clothes and impact force of the vibration sensor.

That is, the laundry treating apparatus according to the present disclosure may perform the step S4 of sensing the entanglement level of cloths in the second rotation step S3, and the step S5 of deciding the entanglement level of entangled clothes in the second rotation step S3.

Figure 7:
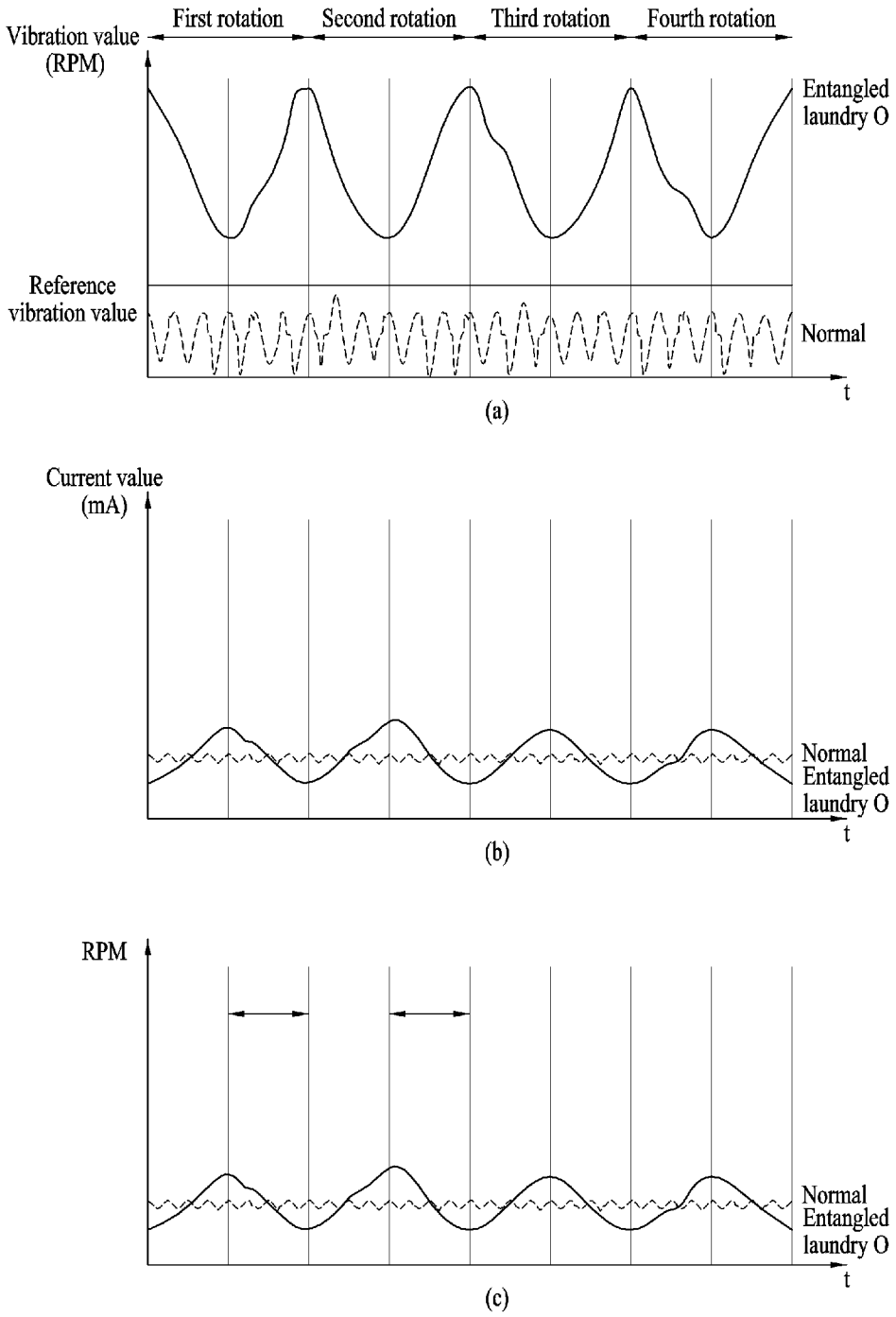
FIG. 7 is a conceptual diagram illustrating a vibration value, a current value, and an RPM value caused by the normal laundry generated in the washing cycle, and a vibration value, a current value, and an RPM value caused by the entangled laundry generated in the washing cycle.

FIG. 7 is a conceptual diagram illustrating a vibration value, a current value, and an RPM value generated in the drum according to different states of laundry.

In more detail, FIG. 7 illustrates the change in the vibration value, the current value, and the RPM value generated when the drum rotates at a constant speed in one direction.

Referring to FIG. 7(*a*), in the situation in which no entangled clothes occur in the drum (i.e., in a normal state), clothes may be continuously lifted upward and drop to the bottom of the drum whenever the drum rotates, vibrations may evenly occur in the drum, the highest vibration value and the lowest vibration value may be densely generated at intervals of a short period of time.

In addition, some clothes may be separated from the inner circumferential surface of the drum, and some other clothes may be in close contact with the inner circumferential surface of the drum, so that the vibration value of the drum may be maintained at a reference vibration value or less.

However, when the entangled clothes occur in the drum, the entangled clothes may be simultaneously lifted upward and then simultaneously drop to the bottom of the drum, such that vibrations may occur with strong force. In addition, the entangled clothes are in contact with and then separated from the inner circumferential surface of the drum in a repeated manner, so that the drum may vibrate with strong force. During one rotation of the drum, the clothes may be lifted once and may then drop to the bottom of the drum once, the maximum vibration value or the minimum vibration value may be generated in response to a time period in which the drum can rotate once.

Therefore, if the clothes in the drum are entangled, a vibration value of the drum is always higher than a reference vibration value generated in the normal state of the drum, and the period of vibrations of the drum including the entangled clothes is higher than that of the normal state of the drum. In this case, the reference vibration value may be defined as a maximum vibration value generated either when no entangled clothes occur in the drum or when no clothes are contained in the drum.

Referring to FIG. 7(*b*), when the clothes are entangled in the drum, the weight of most clothes may be collected at a specific point of the drum. Therefore, when the clothes are lifted from the lowest position to the highest position of the drum during rotation of the drum, the largest amount of currents may be applied to the clothes in the drum. When the clothes drop from the highest position to the lowest position of the drum, loads may disappear from the drum, the current value to be applied to the clothes may be rapidly reduced. By repetition of the above processes, the current value to be applied to the drum may be formed in a repeated shape in which the highest current value and the lowest current value are repeatedly generated.

As described above, the rising section in which the current value increases may refer to a time section in which the clothes in the drum are lifted upward, and the falling section in which the current value decreases may refer to a time section in which the clothes in the drum drop to the bottom of the drum. In addition, a time section in which the vibration value increases may refer to a time section in which clothes drop to the bottom of the drum, and a time section in which the vibration decreases may refer to a time section in which clothes are lifted upward in the drum.

Consequently, when clothes are entangled in the drum, the current value may first increase and the vibration value may then increase. In addition, when the drum rotates only once, the clothes will be lifted and then drop to the bottom of the drum. If a time difference between the rising section in which the current value increases and the other rising section in which the vibration value increases is shorter than a specific time in which the drum rotates only once, it can be recognized that clothes are entangled in the drum.

In contrast, in the situation in which the current value first increases and the vibration value of the drum then increases after lapse of a predetermined time corresponding to at least one rotation of the drum, the controller P of the laundry treating apparatus may determine that the above vibration was not generated due to the above clothes contained in the drum.

Moreover, a time difference between a first time at which the maximum current value occurs and a second time at which the maximum vibration value occurs may correspond to the rotation period of the drum.

On the other hand, waveforms of the current value may be different from waveforms of the vibration value, and the vibration waveforms may be obtained by shifting the current waveforms either by the rotation period of the drum or at intervals of a predetermined time. For example, a valley formed by a difference between the highest current value and the lowest current value may correspond to a ridge portion of the distribution of the vibration values.

Referring to FIG. 7(*c*), the RPM value of the drum may be proportional to the current value applied to the drum, such that the RPM waveform may be similar in shape to the current waveform. Therefore, the period of the current value may correspond to the period of the RPM value.

By the above-mentioned analysis result, the controller P of the laundry treating apparatus may analyze at least one of a change in vibration value, a change in current value, and a change in RPM value in the step S4 of sensing the entangled clothes, such that the controller P can detect the presence or absence of entangled clothes in the drum.

For example, when at least one maximum vibration value or at least one minimum vibration value of the drum is generated whenever the drum rotates only once in the second rotation step S3, the controller P of the laundry treating apparatus may detect the presence of entangled clothes in the drum. When only one entangled group of clothes occurs in the drum, it is expected that the entangled group will be lifted only once and will then drop to the bottom of the drum only once during one rotation of the drum.

In contrast, after the maximum current value is detected in the second rotation step and the maximum vibration value of the drum is then generated, the controller P of the laundry treating apparatus may determine the presence of entangled clothes in the drum. In order to increase the accuracy of detecting the presence or absence of entangled clothes in the drum, in the situation in which the maximum vibration value of the drum is repeatedly generated at least N times after the maximum current value is detected, the laundry treating apparatus may detect the presence of the entangled clothes in the drum. For example, the N times may be set to twice.

In order to further increase the accuracy of such detection, the controller P of the laundry treating apparatus may determine whether the waveforms of the current value of the drum correspond to the waveforms of the RPM value of the drum whenever the drum rotates, such that the controller P may recognize the presence or absence of entangled clothes in the drum.

When a time difference between a first time where the maximum current value occurs in the drum and a second time where the maximum vibration value occurs in the drum whenever the drum rotates is shorter than a time section in which the drum rotates only once, the controller P of the laundry treating apparatus according to the present disclosure may detect the presence of entangled clothes in the drum.

In the second rotation step, when the vibration value of the drum is equal to or higher than a reference vibration value corresponding to a predetermined time, the controller P of the laundry treating apparatus may detect the presence of entangled clothes in the drum. In order to improve accuracy, the predetermined time may be set to a time section in which the drum can rotate at least N times. For example, the predetermined time may be set to the time section in which the drum can rotate at least two times.

In addition, the controller P of the laundry treating apparatus according to the present disclosure may perform the step S5 of deciding the entanglement level of the entangled clothes in the drum. As a result, in the step S5, the controller P may analyze the waveform of the vibration value, the waveform of the current value, the RPM waveform, and a difference (i.e., valley and ridge parts of the graph) in each of vibration, current, and RPM between the maximum value and the minimum value.

The controller P of the laundry treating apparatus according to the present disclosure may select how many times the process of untangling the clothes will be performed according to the entanglement level of the sensed entangled clothes, and may also select the level of untangling the clothes.

Figure 8:
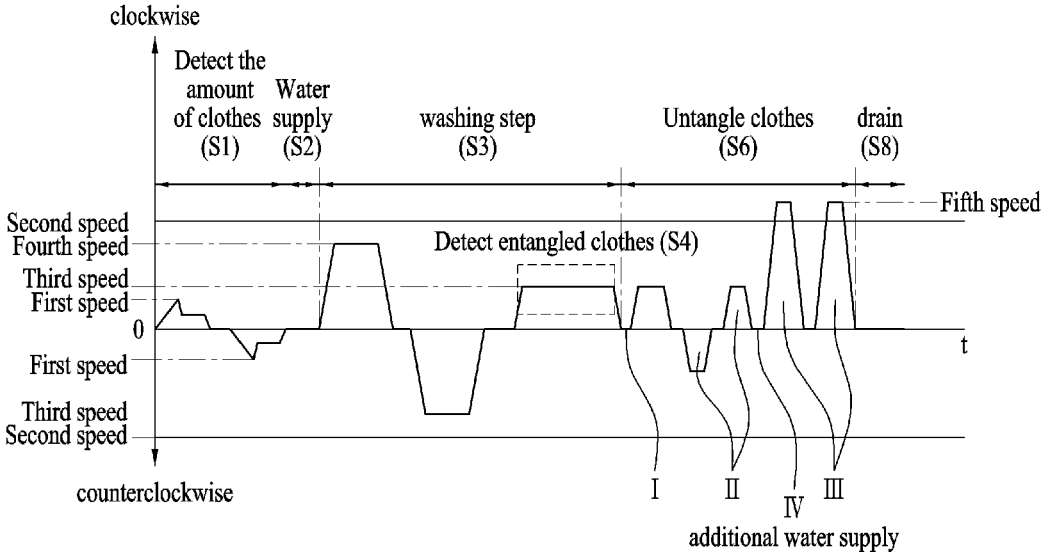
FIG. 8 is a conceptual diagram illustrating a method for enabling the laundry treating apparatus to detect entangled laundry as well as to untangle the laundry according to the present disclosure.

FIG. 8 is a conceptual diagram illustrating a method for performing the step S6 of untangling the clothes in the situation in which the laundry treating apparatus detects the entangled clothes either in the second rotation step S3 or in the step S4 of sensing the entangled clothes from among the washing cycle.

The controller P of the laundry treating apparatus may stop rotation of the drum in the step S3 of untangling the clothes, may cause the clothes to suddenly drop to the bottom of the drum, so that the entangled clothes can be untangled in the drum (Step I). The above step (I) may be carried out when the entanglement level of the entangled clothes is at a low level.

On the other hand, the controller P of the laundry treating apparatus according to the present disclosure may perform switching of the rotation direction of the drum at least one time in the step S6 of untangling the entangled clothes.

That is, the drum may continuously rotate in the clockwise direction and in the counterclockwise direction, so that the entangled clothes can be untangled (Step II). Specifically, the drum may rotate according to any one of the swing motion and the scrub motion. The above-mentioned step (II) may be carried out when the entanglement level of the entangled clothes is relatively high.

On the other hand, during the step S6 of untangling the entangled clothes, the controller P of the laundry treating apparatus according to the present disclosure may allow the drum to rotate at a second speed or higher, and may stop rotation of the drum, such that the controller P may repeatedly perform such rotation and stoppage of the drum at least N times (Step III). The above-mentioned step III may enable the drum to rotate at a dehydration speed or higher in a manner that clothes drop to the bottom of the drum and strong impact can be applied to the clothes in the drum, such that the entangled clothes can be untangled in the drum. In more detail, the step motion may be applied to the drum.

Meanwhile, the controller P of the laundry treating apparatus according to the present disclosure may additionally supply water to the tub in the step S6 of untangling the entangled clothes (Step IV). That is, the entangled clothes may be repeatedly tumbled in the tub, so that the entangled clothes can be untangled in the tub.

In this case, the controller P of the laundry treating apparatus according to the present disclosure may perform the above-mentioned steps II and III in a manner that the drum can rotate either in the additional water supply process or after completion of the additional water supply process.

Thereafter, all of water stored in the drum can be fully discharged to the outside.

Figure 9:
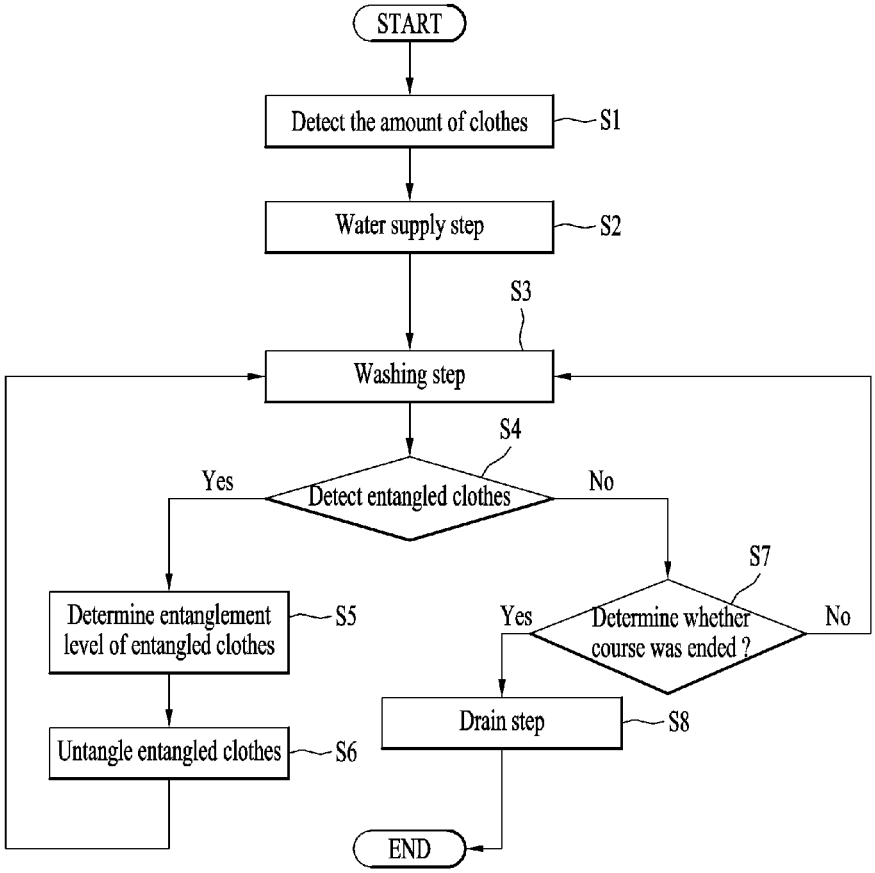
FIG. 9 is a flowchart illustrating a method for controlling the laundry treating apparatus according to the present disclosure.

FIG. 9 is a flowchart illustrating an algorithm for performing the washing cycle of the laundry treating apparatus according to the present disclosure.

Referring to FIG. 9, the laundry treating apparatus may perform the step S1 of detecting the amount of laundry in the drum. In the step S1, the drum may rotate at a first speed. After completion of the water supply process S2, the laundry treating apparatus may perform the washing step S3 in which the drum rotates at a second speed or less.

In the washing step S3, the laundry treating apparatus may perform the step S4 of sensing the presence of entangled clothes in the drum, such that the step S4 may be carried out using at least one of the vibration value of the drum, the current value applied to the drive unit, and the RPM value of the drum. If the entangled clothes are detected, the laundry treating apparatus may also perform the step S5 of detecting the entanglement level of such entangled clothes in the drum as needed.

In this case, if the entangled clothes are detected, the laundry treating apparatus may perform the step S6 of untangling the entangled clothes, such that the laundry treating apparatus may perform at least one of a function of stopping rotation of the drum, a function of agitating the drum, a function of abruptly accelerating the drum and then stopping the drum, and a function of additionally supplying water to the tub, during the step S6 of untangling the entangled clothes.

In addition, when the washing step S3 is performed, the laundry treating apparatus may perform the step S7 of determining whether the washing cycle has been finished, and may finish the washing cycle after completion of the drain step S8 in which water stored in the tub is discharged outside.

Here, assuming that the preset course or the preset optional menu includes specific information indicating that the washing cycle is performed at least two times, the above-mentioned steps may be repeatedly performed.

As is apparent from the above description, the method for controlling the laundry treating apparatus according to the embodiments of the present disclosure can detect the presence or absence of twisted or entangled laundry in the washing cycle.

Even when an unbalance state of a drum is not detected, the method for controlling the laundry treating apparatus according to the embodiments of the present disclosure can detect the presence or absence of twisted or entangled laundry in the drum.

When the presence of twisted or entangled laundry is detected in the washing cycle, the method for controlling the laundry treating apparatus according to the embodiments of the present disclosure can untangle the twisted or entangled laundry in the washing cycle.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

The invention claimed is:

1. A method for controlling a laundry treating apparatus that includes a tub to store water, a drum provided in the tub to accommodate laundry, a driving device coupled to the tub to rotate the drum, and a controller to detect drum vibration, the method comprising:

performing a first rotation operation such that the drum rotates at a first speed or slower;

supplying water to the tub;

performing a second rotation operation such that the drum rotates at a second speed or slower and which is faster than the first speed;

draining water stored in the tub to outside of the tub; and detecting a laundry entangled state by detecting a maximum value or a minimum value of the drum vibration while the drum rotates one turn during the second rotation operation.

2. A method for controlling a laundry treating apparatus that includes a tub to store water, a drum provided in the tub to accommodate laundry, a driving device coupled to the tub to rotate the drum by receiving current, and a controller to detect drum vibration, the method comprising:

performing a first rotation operation such that the drum rotates at a first speed or slower;

supplying water to the tub;

performing a second rotation operation such that the drum rotates at a second speed or slower and which is faster than the first speed;

draining water stored in the tub to outside of the tub; and detecting a laundry entangled state when a maximum value of the drum vibration is detected after detecting a maximum value of the current during the second rotation operation.

3. The method according to claim 2, wherein the detecting of the laundry entangled state includes:

when the maximum value of the drum vibration occurs at least two times after the detection of the maximum value of the current, detecting occurrence of entangled laundry in the drum.

4. The method according to claim 3, wherein the detecting of the occurrence of the entangled laundry includes:

detecting whether a waveform of the current value of the driving device corresponds to a waveform of RPM value of the drum when the drum rotates, and thereby detecting the occurrence of the entangled laundry based on a result of the detection.

5. The method according to claim 2, wherein the detecting of the laundry entangled state includes:

when a difference in a first time where the maximum value of the current occurs and a second time where the maximum value of the drum vibration occurs is equal to or shorter than a specific time in which the drum rotates only once, detecting occurrence of entangled laundry in the drum.

6. A method for controlling a laundry treating apparatus that includes a tub to store water, a drum provided in the tub to accommodate laundry, a driving device coupled to the tub to rotate the drum, and a controller to detect drum vibration, the method comprising:

performing a first rotation operation such that the drum rotates at a first speed or slower;

supplying water to the tub;

performing a second rotation operation such that the drum rotates at a second speed or slower and which is faster than the first speed;

draining water stored in the tub to outside of the tub; and determining a laundry entangled state when a vibration value of the drum during the second rotation operation is greater than or more than a reference vibration value during a predetermined time.

7. The method according to claim 6, wherein the predetermined time is a time period in which the drum rotates at least two times.

8. The method according to claim 7, wherein the determining of the laundry entangled state is performed when the drum rotates in a same direction at a constant speed during the second rotation operation.

9. The method according to claim 8, further comprising:

changing the laundry entangled state by changing a rotation speed of the drum when the laundry state is determined.

10. The method according to claim 9, wherein the performing of the untangling of the laundry includes:

supplying water to the tub.

11. The method according to claim 10, wherein the performing of the untangling of the laundry includes:

rotating the drum.

12. The method according to claim 6, wherein determining the laundry entangled state includes detecting that at least part of the laundry is entangled in the drum.

13. The method according to claim 1, wherein detecting the laundry entangled state includes detecting that at least part of the laundry is entangled in the drum.

14. The method according to claim 2, wherein detecting the laundry entangled state includes detecting that at least part of the laundry is entangled in the drum.

15. The method according to claim 14, comprising performing an untangling of the entangled laundry.

16. The method according to claim 9, wherein the changing of the laundry state includes performing an untangling of the laundry.

17. The method according to claim 15, wherein the performing of the untangling of the entangled laundry includes: stopping rotation of the drum.

18. The method according to claim 15, wherein the performing of the untangling of the entangled laundry includes: changing a rotation direction of the drum at least once.

19. The method according to claim 15, wherein the performing of the untangling of the entangled laundry includes: increasing the rotation speed of the drum such that the drum rotates at a second speed or greaterfaster; and after increasing the rotation speed of the drum, stopping rotation of the drum.

20. The method according to claim 19, further comprising: performing the step of untangling of the entangled laundry at least two times.

* * * * *